US006561363B1

(12) United States Patent
Willhite et al.

(10) Patent No.: US 6,561,363 B1
(45) Date of Patent: May 13, 2003

(54) DISPLAY ASSEMBLY FOR EDIBLE AND NON-EDIBLE OBJECTS

(75) Inventors: Mary Gwen Willhite, Richardson, TX (US); James M. Foxx, Dallas, TX (US); Bobby D. Craig, Garland, TX (US)

(73) Assignee: MGW Group, inc., Plano, TX (US)

( * ) Notice: Subject to any disclaimer, the term of this patent is extended or adjusted under 35 U.S.C. 154(b) by 0 days.

(21) Appl. No.: 10/000,558

(22) Filed: Oct. 23, 2001

(51) Int. Cl.[7] ..... A47F 7/00

(52) U.S. Cl. ..... 211/60.1; 211/85.4; 47/41.01; 220/630; 206/443

(58) Field of Search ..... 211/60.1, 85.4, 211/13.1, 69.1, 70.7; 248/37.3, 37.6, 512, 519, 520, 523–524, 538–539, 534; 220/625, 630, 636; 206/443, 779, 500–565; 47/41.01, 41.11, 41.13

(56) References Cited

U.S. PATENT DOCUMENTS

| | | | | | |
|---|---|---|---|---|---|
| 416,901 | A | * | 12/1889 | Clark | 116/173 |
| 1,611,589 | A | | 12/1926 | Janusek | 47/41.01 |
| 1,643,735 | A | * | 9/1927 | Baker | 118/31 |
| 1,664,436 | A | | 4/1928 | Tonnesen | 47/41.13 |
| 3,158,524 | A | | 11/1964 | Tong | 206/423 |
| 3,431,041 | A | * | 3/1969 | Fontlladosa | 206/732 |
| 3,554,473 | A | * | 1/1971 | Rakov et al. | 248/469 |
| 3,821,061 | A | | 6/1974 | Schier | 220/630 |
| 3,981,099 | A | | 9/1976 | Dziewulski | 220/630 |
| 3,990,179 | A | | 11/1976 | Johnson et al. | 220/630 |
| 4,224,764 | A | | 9/1980 | Dziewulski et al. | 220/630 |
| 4,275,535 | A | * | 6/1981 | Stalzer | 116/209 |
| 4,613,042 | A | * | 9/1986 | Aeschliman | 206/372 |
| 4,958,461 | A | * | 9/1990 | Aldrich | 47/41.01 |
| 5,094,348 | A | * | 3/1992 | Harris et al. | 211/194 |
| D329,663 | S | * | 9/1992 | Galante | D19/75 |
| 5,184,721 | A | * | 2/1993 | Wengyn et al. | 206/366 |
| D339,824 | S | * | 9/1993 | Ancona et al. | D19/75 |
| 5,474,206 | A | | 12/1995 | Herring, Sr. | 220/636 |
| 5,477,637 | A | * | 12/1995 | Aldrich | 47/41.01 |
| 5,509,540 | A | * | 4/1996 | Pomerantz | 211/13.1 |
| 5,655,671 | A | * | 8/1997 | Barry et al. | 211/163 |
| 5,755,325 | A | | 5/1998 | Willhite et al. | 206/443 |
| 5,829,589 | A | * | 11/1998 | Nguyen et al. | 206/366 |
| D401,971 | S | * | 12/1998 | Chang | D19/35 |
| 5,907,124 | A | * | 5/1999 | Reiker | 248/205.3 |
| D418,947 | S | * | 1/2000 | Greiner | D19/77 |
| 6,085,459 | A | * | 7/2000 | Conner | 47/41.01 |
| 6,274,092 | B1 | * | 8/2001 | Itoh | 206/443 |
| 6,457,276 | B1 | * | 10/2002 | Masters | 47/41.01 |
| 2001/0019095 | A1 | * | 9/2001 | Valiulis | 248/188.7 |

FOREIGN PATENT DOCUMENTS

| | | | |
|---|---|---|---|
| GB | 2 083 005 A | 3/1982 | 211/60.1 |

* cited by examiner

*Primary Examiner*—Daniel P. Stodola
*Assistant Examiner*—Jennifer E. Novosad
(74) *Attorney, Agent, or Firm*—Baker Botts L.L.P.

(57) ABSTRACT

A display assembly for edible and non-edible objects includes a display base having a display base upper end and a display base lower end and at least one display base wall connecting the display base upper end and the display base lower end. The display assembly also includes at least one rod support integrally mounted to the at least one display base wall. Each rod support includes a rod support upper end, a rod support lower end, and at least one rod support wall connecting the rod support upper end and the rod support lower end. The rod support wall defines a rod support cavity passing through the rod support upper end and the rod support lower end. The display assembly also includes a rod positioned in the rod support cavity. The rod includes a rod end extending from the display base. An object is attached to the rod end.

7 Claims, 2 Drawing Sheets

DISPLAY ASSEMBLY FOR EDIBLE AND NON-EDIBLE OBJECTS

TECHNICAL FIELD OF THE INVENTION

This invention relates generally to dislays, and more particularly to a display assembly for edible and non-edible objects.

BACKGROUND OF THE INVENTION

Decorative objects are often arranged in a container to create a visually attractive bouquet. For example, arrangements of flowers are often used in decoration or given as gifts. An arrangement of flowers may include various types, shapes, colors and numbers of flowers, as well as other foliage. Similar arrangements are made to include candy, chocolates, cookies or other edible items. In some designs, several cookies are arranged to look like flowers in a container. Sometimes other nonedible items, such as toys or gift items are included in the arrangements.

There are various methods used to create these kinds of display assemblies. In one type of assembly, a container is lined with plastic film and plaster is poured into the lined container, with rods inserted in various positions. Later, after the plaster dries, the decorative objects are attached to the ends of the rods. In another assembly, the decorative objects are initially fixed to the end of a rod or some other object. Then the items are positioned inside of the container using wire, netting, clay or foam as a positioner to hold the rods in place. The rods with the attached items are inserted into the container and held by the positioner to create an attractive arrangement of decorative objects.

While these types of assemblies are commonly used, there are disadvantages associated with each. For example, if wire or netting is used as a positioner, the wire or netting may not be easily secured to the bottom of the container, allowing the wire or netting may become dislodged following assembly. The weight of the decorative objects that may be attached to the rods makes it common for the rods to slip out of position or otherwise become dislodged following assembly. Similarly, foam or clay positioners may become dislodged following assembly.

These types of assemblies also require a substantial amount of labor to produce. Creation of a display assembly is subject to error, especially when numerous individual steps are required. For example, a person making the assembly may have to insert the positioner in the container, determine how to arrange the rods in the container, and then position the rods in the selected arrangement. Each of these steps requires attention from the person, and the time spent to make certain the arrangement is correct will necessarily increase the cost of assembly.

Thus, there is a need for an improved display assembly and method that overcomes the disadvantages associated with the prior art assemblies and methods.

SUMMARY OF THE INVENTION

Particular embodiments of the present invention provide an improved display assembly for edible and nonedible objects that uses just one main piece, the display base, with insertable rods.

In accordance with one embodiment of the present invention, a display assembly for displaying objects includes a display base having a display base upper end and a display base lower end and at least one display base wall connecting the display base upper end and the display base lower end. The display assembly also includes at least one rod support integrally mounted to the at least one display base wall. Each rod support includes a rod support upper end, a rod support lower end, and at least one rod support wall connecting the rod support upper end and the rod support lower end. The rod support wall defines a rod support cavity passing through the rod support upper end and the rod support lower end. The display assembly also includes a rod positioned in the rod support cavity. The rod includes a rod end extending from the display base. An object is attached to the rod end.

Further features and advantages of the invention will become apparent from the following detailed description and accompanying drawings.

BRIEF DESCRIPTION OF THE DRAWINGS

Other objects, advantages, features and characteristics of the present invention, as well as methods, operation and functions of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

DETAILED DESCRIPTION OF THE DRAWINGS

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
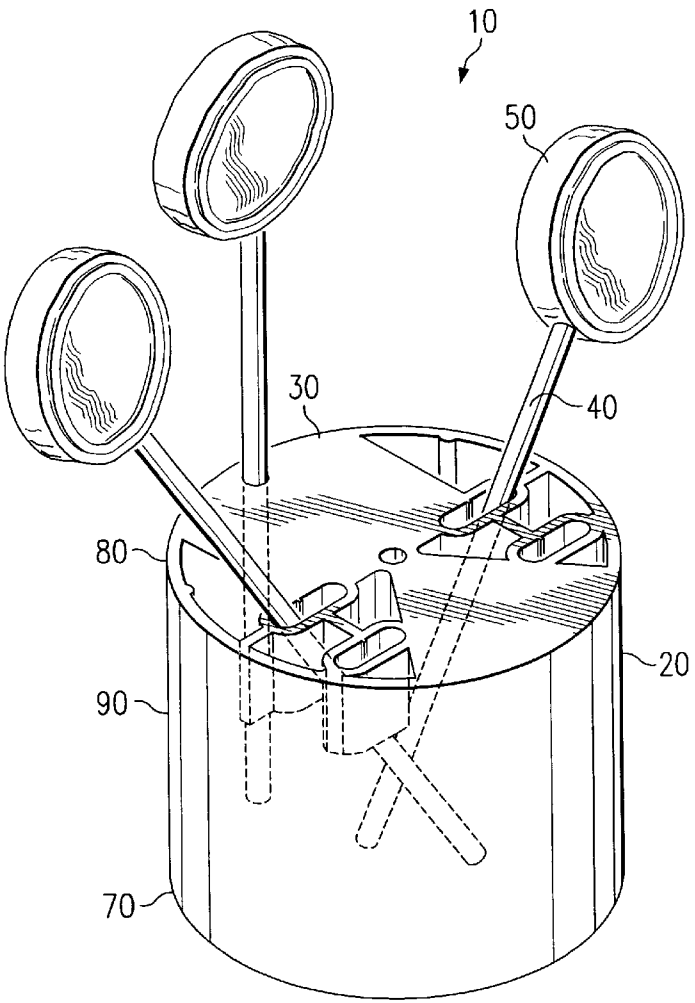
FIG. 1 is a perspective view of a display assembly.

Referring now to FIG. 1, the display assembly of the present invention is designated generally by the numeral 10. Display assembly 10 includes a display base 20, rod supports 30, rods 40, and decorative objects 50. Display assembly 10 may be used to display various decorative objects. The decorative objects may be edible items such as cookies, candy or chocolates. Alternatively, the decorative objects may be nonedible items, such as toys, gift and/or baby items. A combination of edible and nonedible items may also be used as decorative objects. The decorative objects may have an integrated rod or be capable of attachment to the rods in the assembly. For purposes of illustration only, the display assembly will be described using cookies as the decorative objects 50. It will be understood, however, by one skilled in the art, that any other appropriate items are also contemplated by the present invention and may be substituted for the cookies.

The display base 20 may be constructed of plastic or any other suitable material. The surface of the display base 20 may be modified to provide a smooth and/or shiny appearance. In a particular embodiment, the display base is manufactured of polypropylene. The display base may be constructed in a variety of shapes. The shape of the display base may be dictated by the container the display base will be placed in or by the decorative objects it will hold. For example, in a particular embodiment, a cross section of display base 20 is circular so that it may be placed in a mug. Any other appropriate cross-sectional shapes, such as oval or square, may also be used as desired or necessary.

Figure 2:
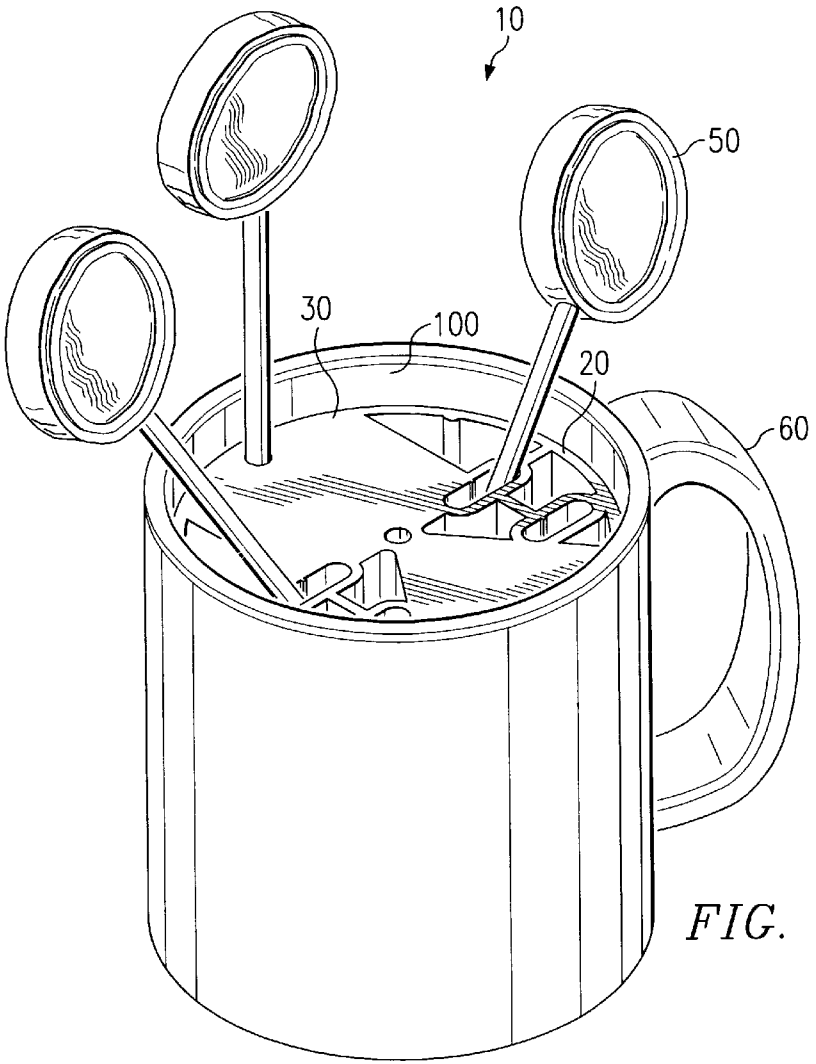
FIG. 2 is a perspective view of a typical use of the display assembly of FIG. 1.

As shown in FIG. 2, the display base 20 may be placed in an external container 60, such as a mug, vase or other similar enclosure. A lower end 70 of the display base 20 will generally be placed in contact with the bottom interior surface of the external container 60. The upper end 80 of the display base 20 is generally below the top edge 100 of the walls of the external container 60. One or more walls 90 connect the upper 80 and lower ends 70 of the display base 20. Multiple display bases 20 may also be placed together in a container and such display bases 20 may or may not be coupled in such an arrangement.

Figure 3:
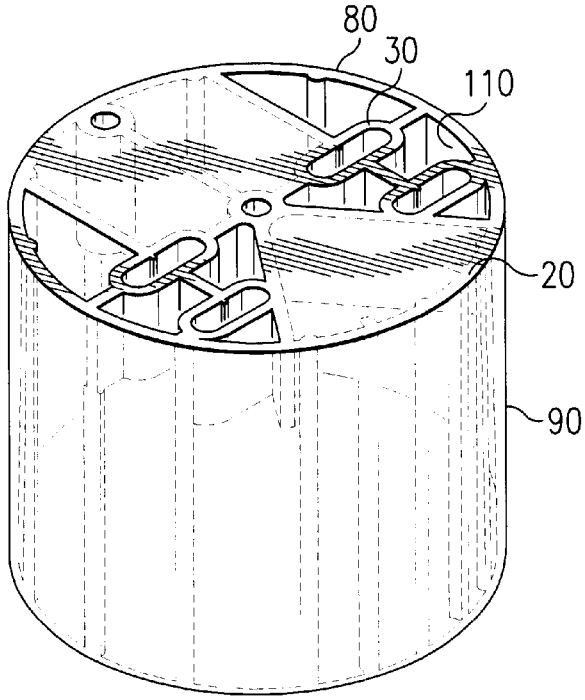
FIG. 3 is a perspective view of the display base of FIG. 1.

As best shown in FIG. 3, rod supports 30 are attached to one another and the interior surface 110 of the display base so that the position of each rod support 30 is fixed within the display base. The rod supports 30 may be made integral to the display base and manufactured of the same material used in constructing the display base 20. In a particular embodiment, the rod supports 30 are integrally mounted to the interior surface 10 of a wall of the display base 20 at the upper end 80 of the display base 20. The rod supports 30 are positioned within the display base in a predetermined pattern. In a particular embodiment, one rod support may be positioned at the center of the display base with other rod supports positioned around the central rod support to simulate a flower arrangement.

Figure 4:
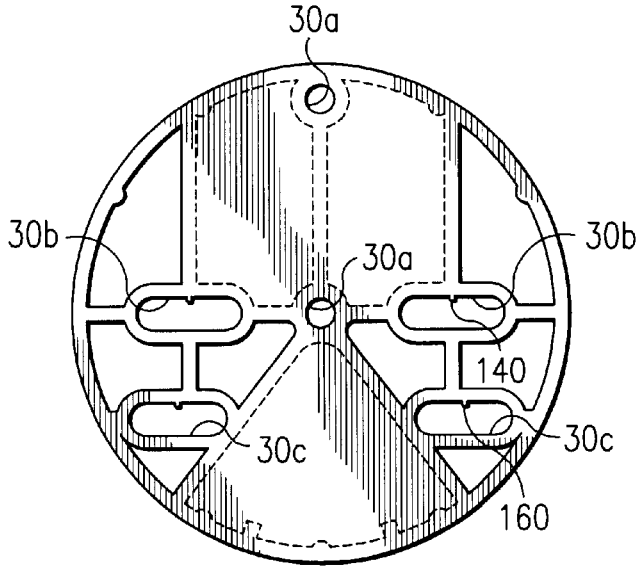
FIG. 4 is a top view of the display base of FIG. 1.

As best shown in FIG. 4, rod supports 30 may be constructed with cavities of varying shapes. In accordance with the illustrated embodiment, the display base 20 includes two circular rod supports 30*a* having a circular cross section. However, any suitable number of circular rod supports may be used. Circular rod supports 30*a* may have an inside diameter substantially equal to the outside diameter of the rods 40, so that the rods are held in place frictionally. Thus a rod 40 inserted into a circular rod 30*a* may extend outwardly substantially parallel to the display base wall or walls 90, as shown in broken lines in FIG. 1.

In the illustrated embodiment, the display base also includes a plurality of oval rod supports 30*c*. Oval rod supports may have an oval inside cross section having a minor axis, with a length substantially equal to the outside diameter of the rods 40 so that the rod is held in place frictionally, and a major axis, with a length greater than the outside diameter of rods 40 to allow the rods to stand at an angle relative to the central axis of the display base. Oval rod supports 30*c* may each include an integrally formed detent 140, which helps to hold the rod 40 frictionally in place. During assembly, a rod 40 can be inserted into an oval rod support 30*c* along its inside edge and parallel to the display base walls 90. The rod 40 may then be pushed outwardly to an angle with respect to the central axis of the display base 20, as shown in FIG. 1. In the illustrated embodiment, display base 20 includes two such oval rod supports 30*c*, although it will be recognized that this number can be varied as necessary or desired.

Other dimensions of oval rod supports 30*b* may also or alternatively be used. These other oval rod supports 30*b* may have an oval inside cross section having a minor axis, with a length substantially equal to the outside diameter of the rods 40 to frictionally hold the rods in place, and a major axis, with a length greater than the outside diameter of rods 40, allowing the rods to stand at an angle relative to the central axis of the display base. As is illustrated, the length of the major axis of oval rod supports 30*b* is greater than the major axis of oval rod supports 30*c*. This difference in the length of the major axis allows the rods 40 placed in oval rod supports 30*b* to extend at a greater angle from the central axis of the display base than rods placed in oval rod supports 30*c*. These oval rod supports 30*b* also each include an integrally formed detent 160, which acts to hold rod 40 frictionally in place.

During assembly of a display, a rod 40 is inserted into an oval rod support 30*b* along its inside edge and parallel to the display base wall 90. The rod 40 is then snapped outwardly to an angle with respect to the central axis of the display base 20 that is greater than the angle of the rods 40 inserted into the oval rod supports with a smaller major axis 30*c*, as shown in FIG. 1. In the preferred embodiment, the display base 20 includes two such oval rod supports 30*b* with this longer major axis, although it will be recognized that this number can be varied as necessary or desired. Furthermore, rod supports can be made of whatever shape dimensions are suitable to hold the rods used in the display assembly. For example, rod supports may have a rectangular or square shape. The rod supports can be placed in any position or orientation suitable for the desired display and the number and size of the rod supports can be varied as appropriate.

Thus, by inserting rods 40 into rod supports 30, an arrangement as shown in FIGS. 1 and 2 may be formed. It will be noted that all of the rod supports 30 may be parallel to the display base walls 90 so that the display base 20 may be easily formed by molding. However, because of the specialized form of the oval rod supports 30*b* and 30*c*, rods 40 extend outwardly from the display base 20 at an angle to the display base wall or walls. Accordingly, when rods 40 are placed in either or both circular rod supports 30*a*, the rods 40 will be upright. When rods 40 are placed in either or both oval rod 30*c*, the rods 40 will lean at a predetermined angle from vertical (after being pushed so that the rods engage with the detents). Where either or both oval rod supports 30*b* with a longer major axis are used, the rods 40 will lean at a larger angle from vertical than the rods 40 placed in either or both oval rod supports 30*c* with a smaller minor axis.

The purchaser of the cookie display may select any appropriate number of cookies or other objects 50 to be included in the display assembly 10. Typically, the purchaser will not select more objects than the number of rod supports. The predetermined arrangement of the rod supports 30 permits the assembler to arrange the cookies in the display base 20 so that the assembly 10 has a pleasing appearance regardless of the number of objects 50 in the assembly 10.

The rods 40 may be manufactured of wood, plastic or any other appropriate material. The material should be sufficiently strong to hold a cookie or other object 50 on one end. In addition, the material should be acceptable for receipt of a food item if appropriate. The rods 40 may have a circular cross section with an outside diameter substantially equal to the inside diameter of circular rod supports 30*a*, however, other shapes of rods and rod supports may also be used. If other shapes are used, then the shapes of the rod supports may be made to conform to the shape of the rods.

Although the invention has been described with a certain degree of particularity, it should be recognized that elements thereof may be altered by persons skilled in the art without departing from the spirit and scope of the invention. The invention is limited only by the following claims and their equivalents.

What is claimed is:

1. A display assembly for displaying objects, comprising:

a display base having a display base upper end and a display base lower end and at least one display base wall connecting the display base upper end and the display base lower end;

one or more rod supports integrally mounted to the at least one display base wall proximate to the display base upper end, each rod support including a rod support upper end substantially coterminous with the display base upper end, a rod support lower end, and at least one rod support wall connecting the rod support upper end and the rod support lower end, the at least one rod support wall defining a rod support cavity passing through the rod support upper end and the rod support lower end;

a rod positioned in the rod support cavity, the rod including a rod end extending from the display base upper end; and an object attached to the rod end;

wherein at least one of said rod supports has an oval cross-section with a detent configured to hold the rod at an acute angle, the oval cross-section allowing the rod to be positioned at the acute angle relative to the display base upper end;

wherein the distance between the display base upper end and the display base lower end is configured such that the rod support lower end is positioned between the display base upper end and the display base lower end.

2. The display assembly of claim 1, wherein the display base wall is cylindrical and the display base upper end and the display base lower end are both circular.

3. The display assembly of claim 1, wherein the rod is configured so as to frictionally engage at least a portion of the rod support wall when positioned in the rod support cavity.

4. The display assembly of claim 1, wherein at least one of said rod supports has a circular cross-section.

5. A display base for displaying objects, comprising:

a display base upper end and a display base lower end;

at least one display base wall connecting the display base upper end and the display base lower end; and one or more rod supports integrally mounted to the at least one display base wall proximate to the display base upper end, each rod support including a rod support upper end substantially coterminous with the display base upper end, a rod support lower end, and at least one rod support wall connecting the rod support upper end and the rod support lower end, the at least one rod support wall defining a rod support cavity passing through the rod support upper end and the rod support lower end;

each rod support configured to support a rod positioned in the rod support cavity such that a rod end of the rod extends from the display base upper end;

wherein at least one of said rod supports has an oval cross-section with a detent configured to hold the rod at an acute angle, the oval cross-section allowing the rod to be positioned at the acute angle relative to the display base upper end;

wherein the distance between the display base upper end and the display base lower end is configured such that the rod support lower end is positioned between the display base upper end and the display base lower end.

6. The display base of claim 5, wherein the display base wall is cylindrical and the display base upper end and the display base lower end are both circular.

7. The display base of claim 5, wherein at least one of said rod supports has a circular cross-section.

* * * * *